United States Patent [19]

Cooper

[11] 4,314,652

[45] Feb. 9, 1982

[54] MULTI-COMPONENT PACKAGE DISPENSING METHOD

[76] Inventor: Douglas E. Cooper, 3065 Argonaut, Rocklin, Calif. 95677

[21] Appl. No.: 98,863

[22] Filed: Nov. 30, 1979

[51] Int. Cl.[3] ..... B65D 35/22

[52] U.S. Cl. ..... 222/1; 222/94

[58] Field of Search ..... 222/491, 494, 94, 95, 222/92, 1; 401/261, 265, 266, 17, 22, 132, 133, 183

[56] References Cited

U.S. PATENT DOCUMENTS

| | | | |
|---|---|---|---|
| 2,049,529 | 8/1936 | Todt et al. | 222/92 |
| 2,136.007 | 11/1938 | Gish | 222/92 |
| 2,671,579 | 3/1954 | Knoblock | 222/92 X |
| 3,105,615 | 10/1963 | Koga | 222/94 |
| 3,980,222 | 9/1976 | Hood | 222/94 X |

*Primary Examiner*—Stanley H. Tollberg

[57] ABSTRACT

A multi-component dispensing package and method for forming and using same. The package stores reactive viscous materials separately for expressing from the package in desired proportional quantities. The components are contained in adjacent parallel tubes of thin, non-resilient deformable material such as aluminum foil which may be protected by a paper cover. In use, one sealed end of the tubes is snipped or severed from the package, and a member is pressed against the package and moved toward the open ends to extrude desired quantities of the components in desired volumetric ratio. This flattens the end of the tube which is then used to mix the extruded components. During the mixing a layer or bead of the mixture coats the flattened end for hermetically sealing the components from each other and from the atmosphere.

2 Claims, 8 Drawing Figures

MULTI-COMPONENT PACKAGE DISPENSING METHOD

BACKGROUND OF THE INVENTION

1. Field of the Invention

The present invention relates to a multi-component dispensing package, and more particularly to packages for containing viscous components in separated condition and for dispensing such components to be mixed together into a final material such as a polymerizable adhesive.

2. Description of the Prior Art

Various adhesives and the like are multi-component, that is, they require that two or more viscous components be mixed together in correct proportions immediately prior to being applied to the objects to be adhered. As soon as the components are mixed, polymerization begins and the resulting mixture soon sets up and hardens. The components must be stored separately and not come in contact with each other to prevent premature polymerization. Also, the components normally must be preserved from contact with the atmosphere to avoid unwanted chemical changes.

Examples of such adhesives are (1) epoxy resins, which require hardeners such as polyamines, (2) polyisocyanate, which requires a hardener such as polyol, (3) unsaturated elastomers, which require plasticizers, and (4) miscellaneous resins, which require a cross-linker, such as styrene. Such materials often utilize additional components as promoters or accelerators. Among these are peroxides (for polyisocyanates, unsaturated elastomers and miscellaneous resins) and acidic catalysts (for penolic resins.

Epoxy adhesives have come into widespread use during the last few years because of numerous advantages, such as:

1. Extreme strength
2. Non-shrinking, thus filling the voids when parts to be bonded are poorly fitted.
3. Relatively inexpensive However, with epoxy adhesives it is critical that the components, usually two, be kept separate until shortly before use in order to prevent premature polymerization or "setting". This characteristic poses some problems, especially for occasional use, as in household applications where the time and trouble involved in dispensing correct proportions, mixing, and storing the materials can exceed the value of using epoxy adhesive for small jobs.

For such smaller applications, originally and still generally today two reactive fluid components (usually quite viscous) are marketed as a packaged pair of conventional, capped tubes from which small quantities of each component can be squeezed out and mixed together just before use. For good results, the user needs to estimate and discharge the ingredients in the correct ratio, usually equal parts. Difficulty is encountered by many users in estimating equal parts of the two ingredients.

It is the general experience that this mode of packaging and dispensing the adhesive components is a cumbersome and quite messy practice. Two caps must be removed, two tubes squeezed, two caps replaced, a stirrer located and used, and some means of applying the mixture devised. All too frequently the viscous components later leak or creep out of the two capped tubes and create a sticky mess whenever they are stored.

On the next occasion of use, the problems are even more frustrating because adhering solidified adhesive can interfere with and modify the expelling orifices so as to interfere with estimating proportions.

In recognition of such problems, several more sophisticated packages have been marketed. One of these has two parallel barrels with end nozzles which discharge in the same region. The two barrels are fitted with pistons linked together so that pushing them inward should discharge equal quantities of the components stored in the barrels. These devices are bulky, relatively expensive, and there are various annoying problems in keeping both of the nozzles unplugged and free of hardened materials.

Other packages provide pairs of plastic packets of components, sometimes joined together, and intend that opening and mixing of the contents of a pair of such packages will provide material for one job. This form of packaging is a bit simpler than the capped tubes, or the tubes with ganged pistons, but the amounts of adhesive is fixed, often leading to wastage, and the number of jobs which can be handled is restricted by the packaging.

Another approach offered commercially consists of a package containing a few small plastic trays having one component in the center and the other separated in the outer annulus. A plastic cover is removed from the tray and the two components then mixed with some instrument. Here again, the amounts of adhesive per job and the number of jobs are severely limited according to the package provided.

Besides the current commercial products described above, a number of devices for dispensing multi-part materials such as adhesives have been described in prior patents. For example, U.S. Pat. No. 2,517,027 describes a Collapsable Tube Like Container For Pastes, one version of which has two or more compartments separated by a longitudinal internal partition. An elastic, slitted neck, or necks, is provided which is stated to allow the materials to be squeezed through the slits, with the slits closing after bending and squeezing stress has been relaxed. The problem with such devices is that the elastic orifices are not perfectly sealed so as to be free from creeping and seepage of the contents. Moreover, encrusted reacted materials may obstruct the slitted orifices.

A number of patented dispensers are based essentially on the familiar toothpaste tube configuration, but having compartments for more than one component. Some of these may serve well for materials which are not designed to harden, but present serious problems when used to package polymerizable adhesives. For example, U.S. Pat. No. 3,335,912 describes a multi-compartment tube with a capped orifice. A somewhat similar design providing a movable partition, or interface, is described in U.S. Pat. No. 3,876,111. None of these solve the basic handling and leaking problems described above in using capped tubes to package such products such as two-part adhesives. In addition, such duplex or triplex assemblies suffer from clogging properties, due to interreaction of the components in the multi-orifice zones, whenever ever used with reactive components.

A special compartmented version is described in U.S. Pat. No. 3,239,105. This device requires a clamp instead of a cap as a closure.

Such squeezable, two-compartment assemblies also have the inherent problem that the comparative viscosities of the components and the comparative sizes of the orifices must be precisely adjusted if manual squeezing is to deliver the components in an acceptable ratio.

Some devices, see U.S. Pat. Nos. 3,261,381 and 2,771,724 provide means for mixing the components with the confines of the devices. Unless all of the mixture can be used at once these are wasteful since the unused portion of the mixture will set up and harden inside the device, thus making it possible to use the device only once.

SUMMARY OF THE INVENTION

The multi-component dispensing package and method of the present invention provides for accurate dispensing of the quantity of adhesive required with the components automatically provided in the correct ratios. The present invention also provides a completely hermetic seal as a natural result of the method of discharging, mixing and applying the product for its intended purpose without requiring additional steps or operations by the user. The present invention also provides a completely new and unobstructed orifice for each new dispensing use without requiring caps, clamps, grommets or other detached closure devices. Moreover, the package of the present invention provides a convenient device for mixing the components together and applying them to the objects to be adhered as a consequence of the mode in which the package is designed to be used.

Accordingly, it is an object of the present invention to provide a dispensing package and method of use therefore in which multiple viscous components are dispensed simultaneously in a desired quantity and in the correct ratio of components.

Another object of the present invention is to provide a multi-component dispensing package which provides a completely hermetic seal as a natural result of the discharging, mixing and applying steps of the present method and without requiring additional steps by the user.

A further object of the present invention is to provide a multi-component dispensing package of the character described which provides new and unobstructed orifices each time the package is used to dispense its contents.

A still further object of the present invention is to provide a multi-component dispensing package of the character described which requires no separate caps or other closure devices.

Another object of the present invention is to provide a multi-component dispensing package of the character set forth in which the package provides a convenient flattened mixing and applying section when utilized according to the method of the present invention.

Other objects of the present invention will in part be obvious and will in part appear hereinafter.

The present invention, accordingly, comprises the several steps and the relation of one or more such steps with respect to each of the others, and the apparatus embodying features of construction, combinations of elements, and arrangements of parts which are adapted to effect such steps, all as exemplified in the following disclosure.

For a fuller understanding of the nature and objects of the present invention, reference should be had to the following detailed description, taken in connection with the accompanying drawing.

Figure 1:
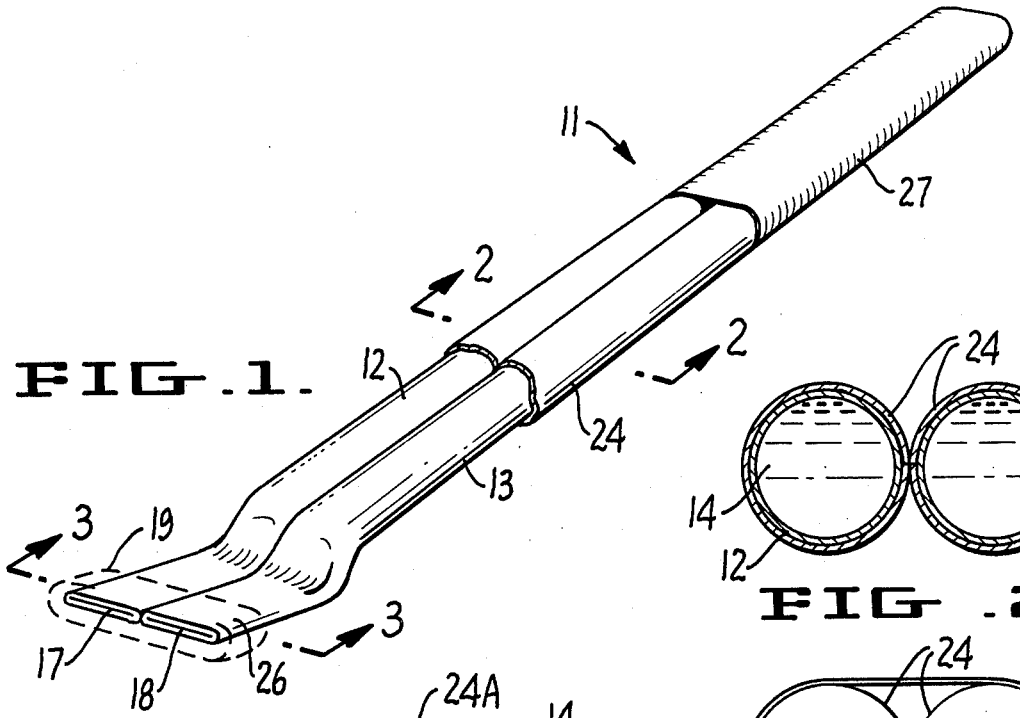
FIG. 1 is a multi-component dispensing package constructed in accordance with the present invention.

Referring now to the drawings in detail, it will be seen that the multi-component dispensing package 11 of the present invention includes a plurality of tubes, in this case two tubes 12 and 13, mounted in substantially parallel proximate relation and adapted to contain a different viscous substance 14 and 16 in each tube, the tubes 12 and 13 being of selected uniform area along substantially their length whereby the volumes of the contents of the tubes are correctly proportioned in laterally corresponding sections of the tubes.

The walls of the tubes 12 and 13 are flexible so that flattening of adjacent sections of the tubes expresses proportioned amounts of the contents from the tubes, with the tube walls being formed of thin, non-resilient, permanently deformable material so that when the ends 17 and 18 of the tubes 12 and 13 are flattened, such ends stay flat and the tubes are sealed against all but minor leakage thereat. A layer 19 of the composite material provided by intermixing the expressed contents of tubes 12 and 13 is carried on the tube ends 17 and 18 for hermetically sealing such ends. The tubes 12 and 13 are cuttable, as by knife or scissors, so that the flattened ends 17 and 18 may be removed for again expressing the contents of the tubes in measured proportions and desired quantities.

It should be appreciated that the number of tubes used in each package can be more than two, and can, in fact, be whatever number are needed to keep separate whatever number of individual components are involved. For example, in the case of adhesives, such components may be pre-polymers and hardening agents which promote polymerization. In some instances, accelerators will also be used. It should also be appreciated that the relative size of each tube is chosen so that a section of adjacent tubes of the same length will contain the different components in the proper volumetric relationship.

Figure 2:
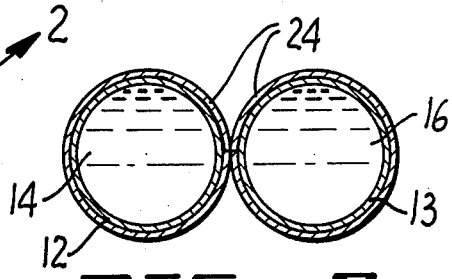
FIG. 2 is an enlarged cross-sectional view taken substantially on the plane of line 2—2 of FIG. 1.
Figure 8:
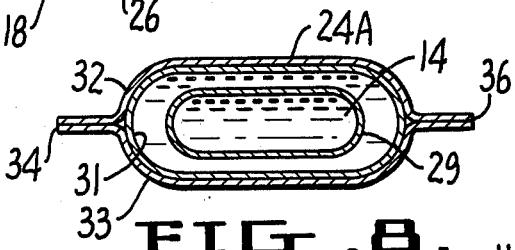
FIG. 8 is a cross-sectional view of a modified form of the device of FIG. 1 and having coaxial tubes for the multiple components.

In accordance with the present invention, the tubes are "ganged", that is they are of equal length and are arranged in close proximity to each other, either in a row as illustrated in FIG. 2, or other bunched arrangement (not shown) or with a tube or tubes within another tube, such as the coaxial arrangement of the general type illustrated in FIG. 8.

The tubes 12 and 13 may be in any desired cross-sectional configuration capable of being flattened by moving an expressing member 21 along the tube, with member 21 at the same time pressing the tubes firmly against a work surface 22. The member 21 may be any convenient object such as a stick, pencil, metal bar, or even the finger of the user.

Figure 4:
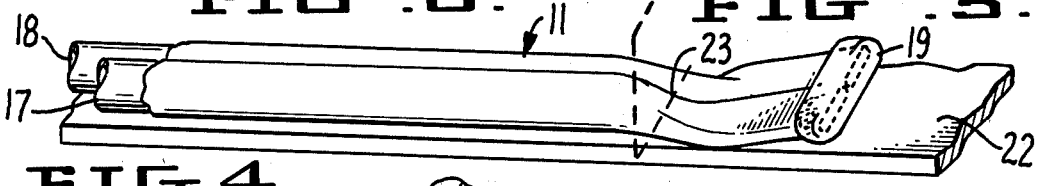
FIG. 4 is a side elevational view, looking from slightly above, of one end of a multi-component dispensing package constructed in accordance with the present invention and illustrating the package end in sealed condition and indicating the location at which the sealed end may be cut off.
Figure 5:
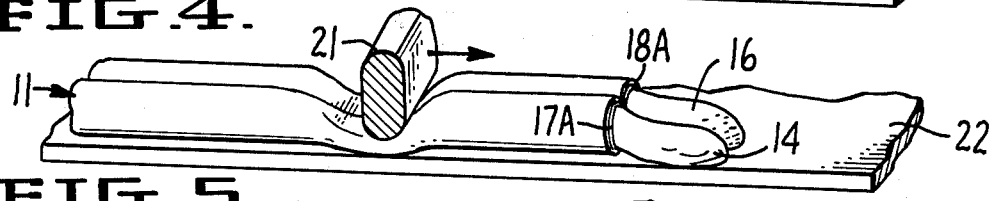
FIG. 5 is a view similar to that of FIG. 4, but illustrating the sealed end cut off and removed, and the contents of the tubes being simultaneously expressed by moving a squeezing device toward the open ends.
Figure 6:
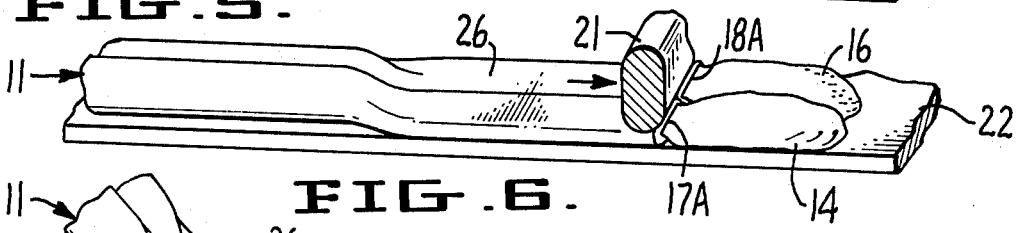
FIG. 6 is a view similar to FIG. 5, but showing the components completely expressed from the flattened portion of the tube.

The mode or method of operation in accordance with the present invention may best be seen in FIGS. 4 through 7 of the accompanying drawing. FIG. 4 illustrates the dispensing end of the package 11 lying on a flat work surface 22. Dotted line 23 illustrated the cut line along which the flattened, sealed tube ends 17 and 18 are severed from the rest of the package when it is again desired to dispense the components. The severing may be accomplished by scissors, knife or any other sharp object capable of cutting through the metal foil tubes 12 and 13 and any covering 24 which may be provided.

The expressing member 21 is then pushed downwardly against the package at a distance from the newly severed tube ends determined by how much of the contents of the tubes are to be removed from the package. As may be seen in FIG. 5 of the drawings, the downward pressure of member 21 exerts hydraulic pressure on the newly severed ends 17A and 18A to force them open and provide orifices through which the contents 14 and 16 can be expelled onto the surface 22.

The member 21 is then moved toward the tube ends 17A and 18A while still pressing the package downwardly against surface 22. This movement of member 21 causes the contents 14 and 16 to be expressed or "squished" from the tubes ahead of member 21.

The portion of the package traversed by member 21 remains flat by reason of the aforesaid forming of the tube walls from thin, non-resilient, permanently deformable material. Preferably, this material comprises a thin metal foil, such as aluminum foil, which can readily be squeezed down flat by member 21, and which will thereafter remain in the squeezed down configuration to substantially seal off the contents of the package.

Figure 7:
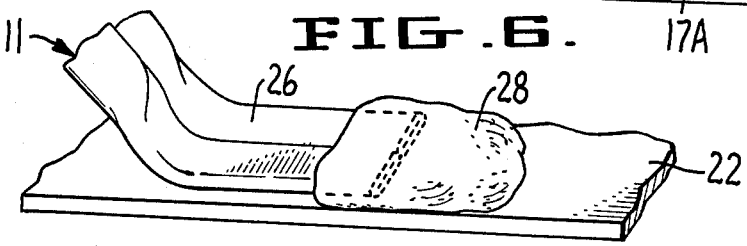
FIG. 7 is a view similar to that of FIG. 6, but illustrating the flattened portion of the tubes being used for mixing and/or applying the contents expressed therefrom.

The flattened area 26 left by the squishing action, is then used to mix the expressed tube contents 14 and 16 together in the manner shown in FIG. 7 of the drawings. It should be noted that the body of the package is rather stiff to serve as a convenient handle, and the flattened area may be bent at an angle, if desired. An extension handle 27 may be provided on package 11 to facilitate the described action as the contents are used and further sections are severed from the package.

As a feature of the present invention, the mixing of the expressed components 14 and 16 into the resulting mass of adhesive 28 also serves to form a thin coating or bead 19 of the adhesive on the flattened ends 17 and 18. As the bead 19 polymerizes and hardens, it completely and hermetically seals off the contents of the individual tubes from each other and from contact with the atmosphere. Thus, the package is securely and hermetically sealed until the next use without requiring caps, clips, clamps or other separate closure devices. Of course, the severing of the flattened end 26 from the remainder of the package along line 23 preparatory to the next use removes the previously flattened portion and bead 19, a new bead 19 being formed automatically as the adhesive is mixed and applied by the new flattened area 26.

In order to obtain a good flattening action, the metal foil used to provide the walls of the tubes 12 and 13 should be as thin as practicable, while still being strong enough not to tear apart as the contents are being squished out by the member 21. In the case of aluminum foil, I have found that a thickness of from one half mil to one and a quarter mil provides good results.

In order to protect the thin walled tubes, they may be enclosed in a protective wrapper 24. This wrapper may be of any suitable sheet material such as a relatively strong paper, plastic, or the like.

Figure 3:
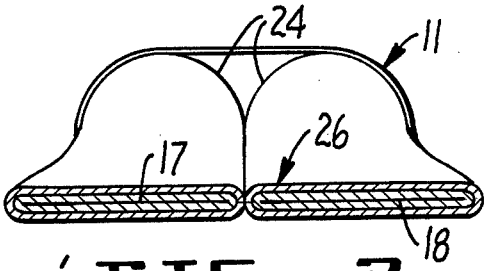
FIG. 3 is an enlarged cross-sectional view taken substantially on the plane of line 3—3 of FIG. 1.

I have also found that, when a material such as paper is used for the covering 24, a plain wrapping of the tubes 12 and 13 may not permit sufficient lateral movement of the tube walls during the flattening process, resulting in crinkling and folding of the tube material and degrading of the mechanical seal. Accordingly, it is desirable to wrap the paper covering 24 around the tubes 12 and 13 in the manner illustrated in FIG. 2 of the drawings so that, when pressed flat as illustrated in FIG. 3, the tube walls will be able to flatten out.

In the form of the invention illustrated in FIG. 8, a thin wall tube 29 of non-resilient, permanently deformable material containing component 14 is positioned within a larger thin walled tube 31 also of non-resilient, permanently deformable material containing component 16. The paper wrapping 24A should be applied in such manner as to permit lateral extension as the tubes are flattened out, and as here shown, the covering 24A is in two sections 32 and 33 joined together at their extreme outer edges 34 and 36. It will be evident that other expedients may be used in connection with the desired expansion of the covering 24, 24A, such as providing longitudinal folds, etc.

From the foregoing, it will be seen that the multicomponent dispensing package and the method for its manufacture and use provide a novel, effective and efficient storing and using of viscid components which are to be mixed together upon expulsion from the package. While described primarily for use in connection with multicomponent adhesives such as epoxys, it will also be apparent that the package and method of the present invention have utility in connection with any viscid materials which must be kept separated and then mixed together in required proportions immediately prior to use.

What is claimed is:

1. The method of mixing and applying proportionate amounts of viscous components of a polymerizable adhesive, comprising the steps of forming parallel tubes of non-resilient deformable material, with said tubes having substantially uniform and proportionate areas along their lengths, placing one of said components in each of said tubes, sealing the ends of said tubes to provide a protective package to keep said components separated and from contact with the atmosphere, severing the sealed ends of said tubes from one end of said package, simultaneously squeezing said tubes flat from a point a measured distance from said last named end of said package so as to express measured proportional quantities of said components from said last named end of said package while at the same time flattening said tubes over said distance, depositing said proportional quantities of said components on a work surface as they are expressed from said package, mixing said components together on said work surface utilizing said flattened end of said package from which said components were expelled, and retaining a layer of the mixed components on the flattened ends of said tubes for further sealing in of their contents.

2. The method as described in claim 1 and comprising the further step of applying the mixed components to the objects to be adhered with said flattened end of said package.

* * * * *